United States Patent [19]

Bouille

[11] 4,005,773

[45] Feb. 1, 1977

[54] TRANSPORTATION DEVICE HAVING MOVABLE HANDRAILS

[75] Inventor: Joseph R. Bouille, Gettysburg, Pa.

[73] Assignee: Westinghouse Electric Corporation, Pittsburgh, Pa.

[22] Filed: Dec. 10, 1974

[21] Appl. No.: 531,429

[52] U.S. Cl. ..... 198/335; 198/835; 301/63 PW

[51] Int. Cl.[2] ..... B66B 9/14

[58] Field of Search ..... 198/16 R, 18, 17, 203; 301/63 PW

[56] References Cited

UNITED STATES PATENTS

| | | | |
|---|---|---|---|
| 3,779,360 | 12/1973 | Taher et al. | 198/16 R |
| 3,815,959 | 6/1974 | Hill | 301/63 PW |
| 3,894,776 | 7/1975 | Black | 301/63 PW X |

*Primary Examiner*—Robert B. Reeves
*Assistant Examiner*—John P. Shannon
*Attorney, Agent, or Firm*—D. R. Lackey

[57] ABSTRACT

Transportation apparatus, including an endless handrail and drive therefor. The handrail drive includes traction and pressure rollers disposed in driving engagement with the handrail. At least certain of the traction rollers each includes tire and hub portions formed of first and second integrally bonded elastomeric materials, respectively, with the first elastomeric material being selected to provide a predetermined dynamic coefficient of friction with the handrail, and the second elastomeric material being a relatively harder material selected to provide a supporting structure for the first elastomeric material.

4 Claims, 5 Drawing Figures

TRANSPORTATION DEVICE HAVING MOVABLE HANDRAILS

BACKGROUND OF THE INVENTION

1. Field of the Invention

The invention relates in general to transportation apparatus for moving people between spaced landings, such as electric stairways and movable walks, and more specifically to the handrails and drive therefor, of such apparatus.

2. Description of the Prior Art

Transportation devices for the movement of passengers between spaced points or landings, such as electric stairways and walks, employ endless flexible handrails which are driven in synchronism with the conveyor portion of the device. The handrails are supported by balustrades which direct the handrails above the conveyor on which the passengers stand during the load run. The drives for the handrails are normally applied thereto during the return run of the handrails.

The handrail drive commonly employs a plurality of spaced pairs of rollers, with the handrail passing between the rollers of each pair. Each pair of rollers includes a driven traction roller and a pressure roller, with the pressure roller being resiliently biased towards its associated traction roller.

Handrail drive arrangements of the prior art are illustrated in U.S. Pats. Nos. 3,414,109 and 3,779,360 which are assigned to the same assignee of the present application. As illustrated in these patents, the traction roller includes a metallic hub portion, commonly a machined casting, upon which an elastomeric or rubber tire is mounted. While this prior art traction roller construction functions satisfactorily, it adds substantially to the cost and weight of the handrail drive unit. Thus, it would be desirable to reduce the manufacturing cost, and weight of the traction rollers, if these objectives can be achieved without deleteriously affecting the performance and service life of traction rollers.

SUMMARY OF THE INVENTION

Briefly, the present invention is new and improved transportation apparatus having a movable handrail, such as a movable walk or stairway, which includes a lighter, lower cost handrail drive unit. At least the traction rollers of the handrail drive have their tire and hub portions formed of first and second integrally bonded elastomeric materials, respectively, which may be simultaneously cast. This con- struction eliminates the prior art steps of casting the hub from a metallic material, machining the cast hub, preparing an elastomeric tire, and mounting and bonding the tire on the machined metallic hub.

The first elastomeric material is selected to provide the desired dynamic coefficient of friction with a handrail when it is in driving engagement therewith, and the second elastomeric material is a relatively harder material selected to function as a support for the first elastomeric material. The composite elastomeric construction of the traction roller substantially reduces both the manufacturing cost of the traction roller, as well as the cost and weight of the resulting handrail drive unit, with no impairment of function. The fact that this construction enables the hub and tire to be simultaneously cast of elastomeric materials, from the same or different elastomeric families, formulated to provide the desired hardness values of each, improves the handrail drive unit as there is less tendency for the tire to come loose from the hub during service. Instead of a sharp line of demarcation between the tire and hub, as in prior art traction rollers, the tire and hub may be integrally bonded during simultaneous casting, which causes the two elastomeric materials to mix at the boundary, solidify and cure without a sharply defined demarcation line.

BRIEF DESCRIPTION OF THE DRAWINGS

The invention may be better understood and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
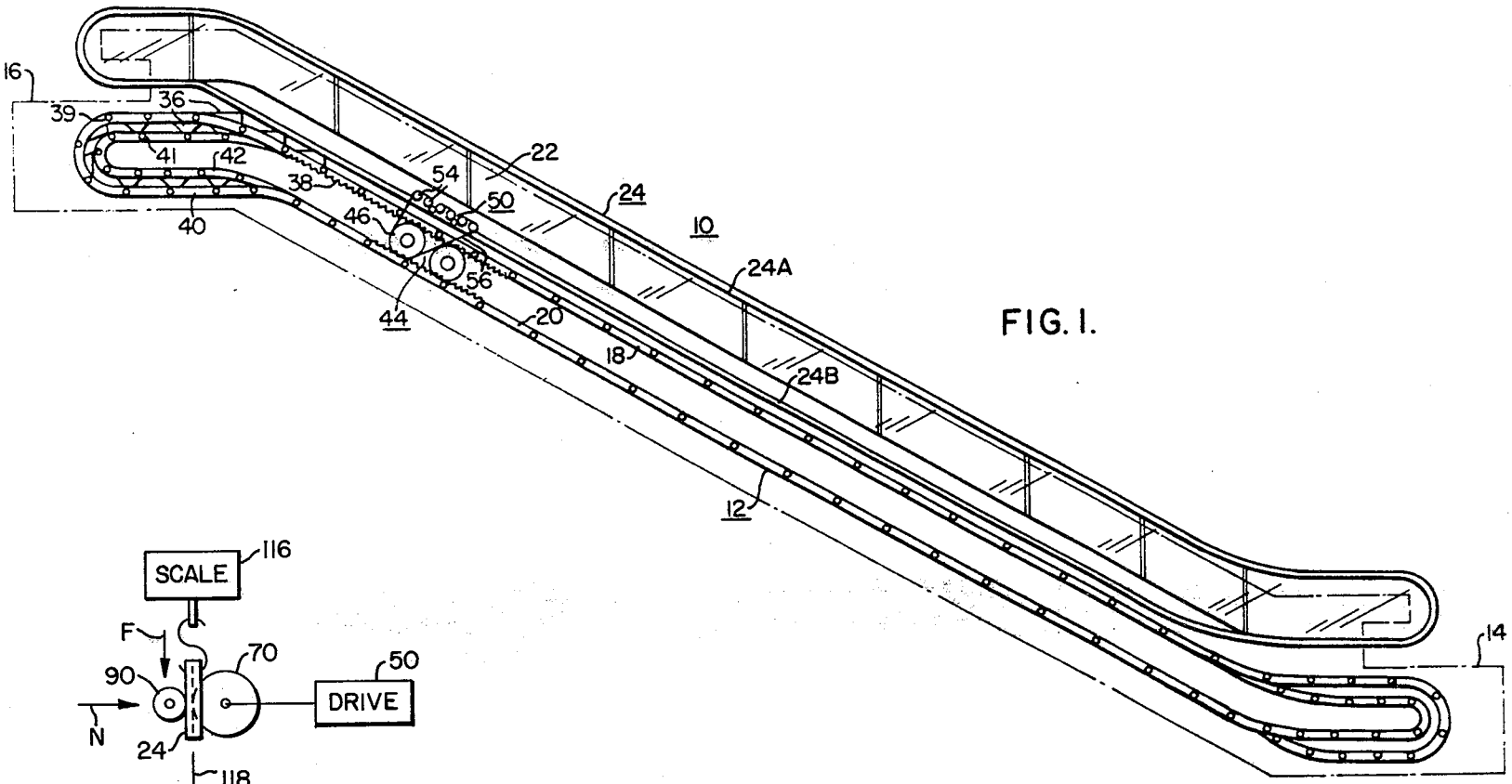
FIG. 1 is a view in side elevation of a transportation device of the type which may be constructed according to the teachings of the invention.

Referring now to the drawings, and FIG. 1 in particular, there is shown a transportation device 10 of the type which may utilize the teachings of the invention. Device 10 employs a conveyor 12 for transporting passengers between a first landing 14 and a second landing 16. The conveyor 12 is preferably of the endless type conventionally used in moving walks and electric stairways. If the conveyor 12 is a moving walk, it may have a belt-type treadway or a pallet-type. For purposes of example, it will be assumed that the conveyor 12 is in the form of a moving stairway.

Conveyor 12 includes an upper load run 18 on which passengers stand while being transported between the landings, and a lower return run 20.

A balustrade 22 is disposed above the conveyor 12 for guiding a continuous, flexible handrail 24. A balustrade guides the handrail 24 as it moves about a closed loop which includes an upper run 24A during which a surface of the handrail 24 may be grasped by passengers as they are transported along the conveyor 12, and a lower return run 24B.

Figure 2:
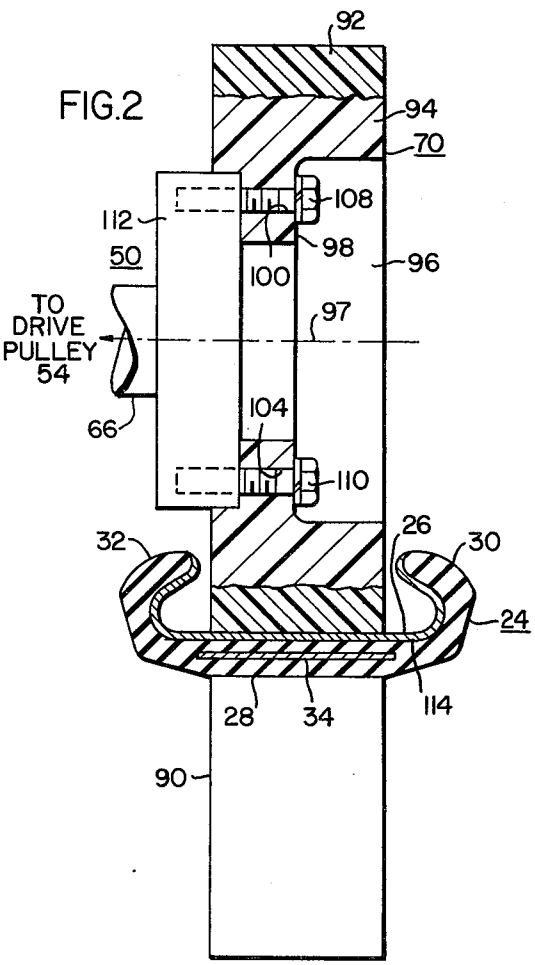
FIG. 2 is an elevational view, partially in section, of a handrail drive arrangement which includes cooperative traction and pressure rollers constructed according to the teachings of the invention, which may be used in the transportation device shown in FIG. 1.

The handrail 24, shown in section in FIG. 2, has a substantially C-shaped cross section, having first and second substantially flat, parallel major opposed surfaces 26 and 28, respectively, which define the major body portion of the handrail. Legs 30 and 32 project in a common direction from the sides of the handrail and then curve inwardly toward major side 26. Major side 26 is thus the inner side of the handrail which rides on the support structure of the balustrade 22 and major side 28 is the outer side, which is grasped by persons on the conveyor 12 during the upper run 24A of the handrail. Handrail 24 may be of any suitable construction, conventionally being formed of an elastomer, such as rubber, in which reinforcing materials, such as canvas, are embedded. Inextensible members, shown generally at 34, such as steel ribbon or wire, are embedded in the elastomer to minimize stretching of the handrail 24 during use. The handrail 24 is constructed as an elongated strip and after it is cut to length, the ends are spliced and vulcanized to produce an endless or closed loop.

The balustrade 22 may be transparent, as indicated, or opaque, as desired. The handrail 24 is guided around the balustrade by suitable guide means, such as a T-shaped guide which is located within the cross section of the handrail 24. The guide means may be conventional, or it may be continuous to the extent that any gaps are bridged by the handrail 24 without lateral movement of the handrail, permitting the handrail to be pushed as well as pulled by the handrail drive means around the guide loop. This "continuous" guide concept of handrail operation is disclosed in U.S. Pat. No. 3,712,447, which is assigned to the same assignee as the present application.

Conveyor 12 includes a plurality of steps 36, only a few of which are shown in FIG. 1. The steps 36 move in a closed path, with the conveyor 12 being driven in the conventional manner, such as illustrated in U.S. Pat. No. 3,414,109 or the conveyor 12 may be driven by a modular drive arrangement, as disclosed in U.S. Pat. No. 3,677,388, both of which are assigned to the same assignee as the present application. As disclosed in U.S. Pat. No. 3,677,388 the conveyor 12 includes an endless belt formed of toothed links 38, to which the steps 36 are connected. The steps 36 are supported by main and trailer rollers 39 and 41, respectively, which cooperate with main and trailer tracks 40 and 42, respectively, to guide the steps in the endless path.

The steps are driven by a modular drive unit 44 which includes sprocket wheels and a drive chain for engaging the toothed links. The modular drive unit 44 includes a handrail drive pulley 46 on each side of the conveyor, which drives the handrail drive units 50 disposed on both sides of the conveyor 12. The handrail drive units 50 on each side of the conveyor 12 are of similar construction, and additional handrail drive units provided when additional modular drive units are required on longer runs would also be similar.

Drive unit 50 includes a plurality of auxiliary drive pulleys or sprocket wheels 54, which are driven by the sprocket wheel 46 via a drive belt or sprocket chain 56. Six auxiliary drive pulleys 54 are illustrated in FIG. 1, with the actual number used depending upon design parameters.

Auxiliary handrail drive pulleys 54 may be toothed, with the sprocket chain 56 having cooperative teeth formed thereon of any suitable form. The sprocket chain may be a timing belt formed of metal, or of an elastomeric material having a metallic embedment which makes the belt substantially inextensible.

Each drive pulley 54 is keyed to one end of a shaft, with the shaft being journaled for rotation in bearings disposed about the central portion of the shaft. A traction or drive roller is fixed to the opposite end of this shaft. FIG. 2 illustrates the shaft and traction roller in detail, such as shaft 66 and traction roller 70. Thus, when auxiliary drive pulley 54 is rotated by the drive belt 56, a traction roller 70 on the same shaft is also driven.

Traction roller 70 is disposed such that a portion of its periphery or rim engages the inner surface 26 of the handrail 24.

A pressure roller 90 is provided for each traction roller 70. Each pressure roller biases the handrail 24 toward its associated traction roller 70. Each pressure roller 90 is constructed such that it does not scratch or mark the outer surface of the handrail, which it contacts as it presses or biases the handrail 24 firmly against the traction roller 70 disposed on the opposite side of the handrail. An imaginary line perpendicular to the surfaces 26 and 28 of the handrail 24, which passes through the rotational axis of a traction roller, will also pass through the rotational axis of a pressure roller 90, since the traction and pressure rollers are provided in cooperative pairs, each pair providing a driving point for squeezing and propelling the handrail 24 around the closed guide loop.

Figure 3:
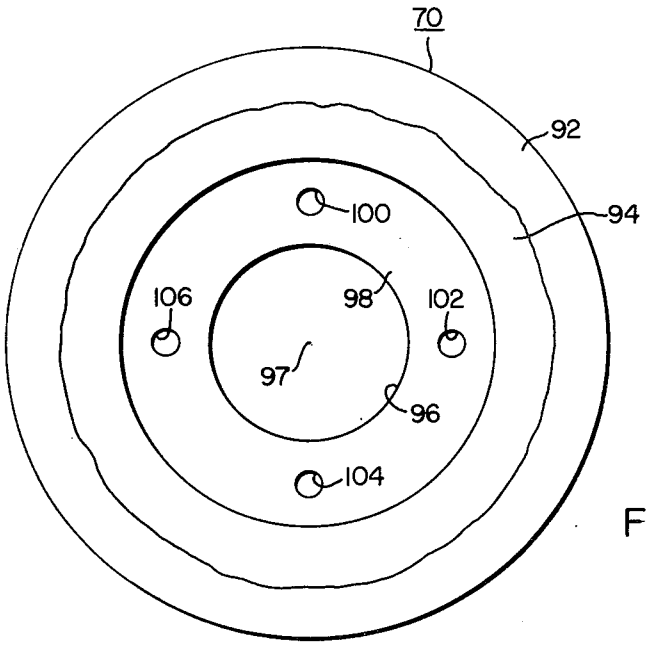
FIG. 3 is an elevational view of the face of the traction roller shown in FIG. 2.

Traction roller 70 is formed of first and second integrally bonded elastomeric materials 92 and 94, respectively, shaped or molded to predetermined configurations which function as the tire and hub portions, respectively. The second elastomeric material 94 is a rigid, solid material which has a density, hardness and mechanical strength selected to be consistent with its function as the hub portion of the traction roller. The hub portion 94 includes means for fixing the traction roller 70 to the end of the shaft 66. For example, as illustrated in FIGS. 2 and 3, the hub portion may include a central, stepped opening 96 which is symmetrical about a central rotational axis 97 of the traction roller 70, with the step in the opening being formed by a flange 98 which extends into and narrows the opening. A plurality of smaller openings 100, 102, 104 and 106 are symmetrically distributed about the flange 98, for receiving bolts, such as bolts 108 and 110. The longitudinal axes of these smaller openings are parallel to the rotational axis 97 of the traction roller 70. The bolts extend through the openings in the flange 98 into tapped openings in a metallic flange member 112 which is welded or otherwise secured to the end of the shaft 66. Thus, the traction roller 70 may be easily assembled to the shaft 66, and just as easily removed for maintenance purposes. The second elastomeric material may be any suitable elastomer, natural or synthetic, preferably having a type D durometer in the range of about 70–75. The hardness is measured according to the "The Standard Method of Test for Indentation Hardness of Rubber and Plastic by Means of a Durometer," as set forth in the 1974 Annual Book of ASTM Standards, part 37. A solid polyurethane, such as Plastomeric's Number 32751 has been found to be excellent.

The first elastomeric material 92 is a relatively softer or more elastic solid material than the second elastomeric material 94, with this portion of the traction roller 70, which functions as the tire portion, being selected to provide the desired coefficient of friction between the outer periphery of the traction roller and the inner surface 26 of the handrail 24. As illustrated in FIG. 2, the inner surface 26 of the handrail 24 is normally formed of canvas or cotton duck material 114.

Figure 4:
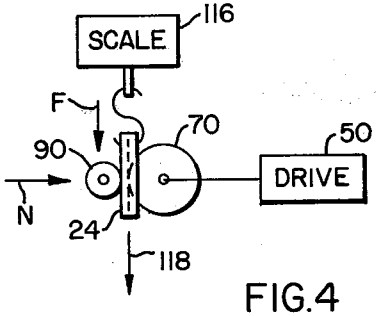
FIG. 4 is a schematic representation of the arrangement used to provide an indication of the dynamic coefficient of friction between a handrail and cooperative traction and pressure roller.

It is critical for the proper operation of the handrail drive arrangement that the coefficient of friction between the traction roller 70 and the handrail 24 be at least 0.6, and it is preferable that it be higher. FIG. 4 illustrates the arrangement for determining the coefficient of friction for the handrail drive application. A section of handrail 24 is suspended from a scale 116, and a cooperative pair of traction and pressure rollers 90 and 70, respectively, are disposed to contact the first and second major opposed surfaces of the handrail 24, as illustrated in FIG. 2. A drive 50 is connected to the traction roller and it is arranged to drive the handrail 24 vertically downward in the direction of arrow 118. The pressure roller 90 is biased against the handrail 24 and the traction roller 70, with a predetermined force, as illustrated by the arrow N. The force applied to the scale by the handrail, indicated by arrow F is observed, and the scale reading is recorded when slippage first occurs between the traction roller 70 and the handrail 24. The co- efficient of friction, which is referred to in this specification as the dynamic coefficient of friction in order to indicate the coefficient of friction obtained by the arrangement illustrated in FIG. 4, is determined by dividing the scale reading F by the biasing force N. With a biasing force N of 120 pounds, the scale reading F at slippage should be at least about 75 pounds for proper operation of the handrail drive.

The first elastomeric material may be any suitable elastomer, natural or synthetic, preferably having a type A durometer of about 85, such as $85 \pm 2$. A solid polyurethane, such as Platomeric's Number 32850 has been found to be excellent, providing a dynamic coefficient of friction of about 1.0, which is well above the required minimum.

Figure 5:
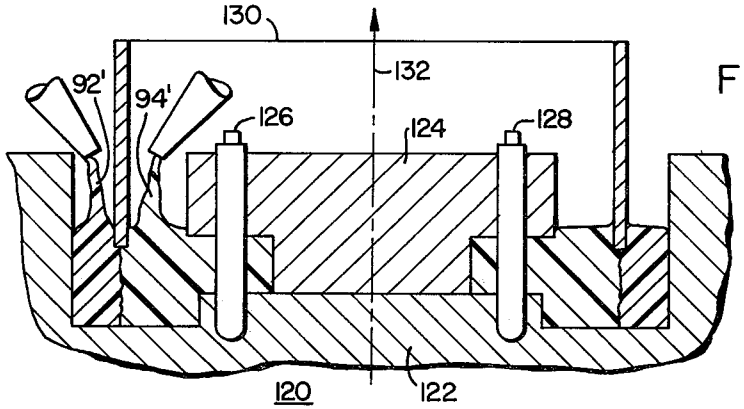
FIG. 5 is an elevational view, in section, of a mold which may be used for simultaneously casting the hub and tire portions of the traction roller shown in FIGS. 2 and 3.

The first and second elastomeric materials should be selected for bonding compatibility, as it is critical that the two materials be susceptible to providing strong, permanent bonds between them. FIG. 5 illustrates an arrangement for simultaneously casting the first and second elastomeric materials, referred to with reference numerals 92′ and 94′, respectively, in FIG. 5 which arrangement results in substantially a one piece construction with no sharp line of demarcation between the two elastomeric materials. This simultaneous casting of the two elastomeric materials provides the preferred bond, but molding and other joining methods may be used if they provide an adequate bond between the two materials which will not loosen or delaminate during usage of the traction roller.

More specifically, FIG. 5 is an elevational view, in section, of a two-part mold 120, having a centerline 132 which is coincident with the rotational axis 97 of the traction roller to be cast. Mold 120 includes a base portion 122 and an insert 124. The base portion 122 defines the outer dimensions of the traction roller, and in general forms the mold cavity, while the insert 124 defines the inner dimensions of the roller. A plurality of pins, such as pins 126 and 128, extend from the insert 124 through the portion of the mold cavity in which the flange 98 of the traction roller will be formed, with the pins extending into cooperative openings disposed in the base portion 122. The pins define the openings 100, 102, 104 and 106 through the flange 98 of the cast traction roller. A thin walled, circular tube member 130 is disposed within the cavity of the mold, with the longitudinal axis of the tubular member 130 coinciding with the centerline 132 of the mold 120. The inner and outer diameters of the tubular member 130 are selected such that the mean diameter falls on the desired demarcation line or zone between the first and second elastomeric materials.

When the mold 120 is prepared, with the base 122 and insert 124 in assembled relation, and with the tubular member 130 positioned within the mold cavity with its lower end resting on the flat surface of the base portion 122, the first and second elastomeric materials 92′ and 94′ are prepared and poured at their proper elevated casting temperatures into their respective portions of the mold cavity, i.e., on opposite sides of the divider wall provided by the tubular member 130. As the two liquid casting materials are poured, the tubular member 130 is lifted vertically at a rate which maintains its lower end below the level of the two casting materials. This arrangement directs the two casting materials to the proper portions of the mold, and then allows the two materials to contact one another while they are still at their elevated casting temperatures. If the materials selected are compatible, they will intermingle slightly without reducing the strength of the casting at the demarcation zone. Thus, when the casting solidifies and is cured, the two elastomeric materials will be integrally bonded without a sharp demarcation line between the materials. If the first and second elastomeric materials 92′ and 94′ are both polyurethanes, as set forth in the example, they have excellent compatibility and provide a bond which will not delaminate, but other compatible elastomeric materials may be used.

In summary, there has been disclosed a new and improved transportation device, such as a movable walk or stairway which has a movable handrail driven in synchronism with a conveyor portion of the walk or stairway. The handrail drive includes new and improved traction rollers which are substantially lighter than those of the prior art, substantially less costly to manufacture than those of the prior art, and which provide a dynamic coefficient of friction in a handrail drive combination well above the minimum requirement. While the composite roller construction has been disclosed relative to use as the traction roller, since the traction roller is larger and more costly than the pressure roller, it would also be suitable to use the same construction for the pressure roller, if desired.

I claim as my invention:

1. Transportation apparatus comprising:

an endless handrail having first and second major opposed surfaces, a supporting structure for guiding said handrail in a closed loop, and driving means for moving said handrail about the closed loop defined by said supporting structure, said driving means including driven shaft members, traction rollers fixed to said driven shaft members, and pressure rollers, said traction and pressure rollers being cooperatively positioned against the first and second surfaces of said handrail, at least certain of said traction rollers including tire and hub portions formed of first and second elastomeric materials, respectively, said first and second elastomeric materials being bonded together without a sharp line of demarcation, wherein the interface between the tire and hub portion is a zone which includes a mixture of said first and second elastomeric materials, said first elastomeric material being disposed in driving contact with said handrail, said first elastomeric material being selected to provide a dynamic coefficient of friction with said handrail of at least 0.6, said second elastomeric material being a relatively harder material than said first elastomeric material, to provide a support therefor.

2. The transportation apparatus of claim 1 wherein the first and second elastomeric materials are each a polyurethane.

3. The transportation apparatus of claim 1 wherein the first elastomeric material is selected to provide a type A durometer of about 85.

4. The transportation apparatus of claim 1 wherein the first elastomeric material is selected to provide a type A durometer of about 85, and the second elastomeric material is selected to provide a type D durometer in a range of about 70–75.

* * * * *